US009306277B2

(12) United States Patent
Miyake

(10) Patent No.: US 9,306,277 B2
(45) Date of Patent: Apr. 5, 2016

(54) MULTI-ANTENNA DEVICE AND COMMUNICATION DEVICE

(71) Applicant: Funai Electric Co., Ltd., Daito, Osaka (JP)

(72) Inventor: Yasunari Miyake, Osaka (JP)

(73) Assignee: FUNAI ELECTRIC CO., LTD., Osaka (JP)

( * ) Notice: Subject to any disclaimer, the term of this patent is extended or adjusted under 35 U.S.C. 154(b) by 141 days.

(21) Appl. No.: 14/077,755

(22) Filed: Nov. 12, 2013

(65) Prior Publication Data

US 2014/0139399 A1 May 22, 2014

(30) Foreign Application Priority Data

Nov. 20, 2012 (JP) ..... 2012-254225

(51) Int. Cl.
*H01Q 1/24* (2006.01)
*H01Q 21/00* (2006.01)
*H01Q 1/52* (2006.01)

(52) U.S. Cl.
CPC ..... *H01Q 1/521* (2013.01); *H01Q 1/243* (2013.01)

(58) Field of Classification Search
CPC ..... H01Q 1/521; H01Q 1/243
USPC ..... 343/702, 893, 846
See application file for complete search history.

(56) References Cited

U.S. PATENT DOCUMENTS

| | | | | |
|---|---|---|---|---|
| 7,142,886 | B2 * | 11/2006 | Murayama et al. | 455/556.1 |
| 7,148,849 | B2 * | 12/2006 | Lin | 343/700 MS |
| 8,391,927 | B2 * | 3/2013 | Castaneda et al. | 455/562.1 |
| 2002/0021250 | A1 * | 2/2002 | Asano et al. | 343/702 |
| 2002/0190905 | A1 | 12/2002 | Flint et al. | |
| 2004/0150579 | A1 | 8/2004 | Dotto et al. | |
| 2010/0220015 | A1 | 9/2010 | Pintos et al. | |

FOREIGN PATENT DOCUMENTS

| | | | |
|---|---|---|---|
| EP | 1617513 | A1 | 1/2006 |
| JP | 2010-525680 | A | 7/2010 |
| WO | 2008-131157 | A | 10/2008 |

OTHER PUBLICATIONS

Extended European Search Report of the corresponding European Application No. 13192960.6, dated Mar. 4, 2014.

* cited by examiner

*Primary Examiner* — Hoanganh Le
(74) *Attorney, Agent, or Firm* — Global IP Counselors, LLP

(57) ABSTRACT

A multi-antenna device includes a grounding plate, a first antenna and a second antenna. The first antenna includes a first feed element that is grounded to the grounding plate via a first feed point. The second antenna includes a second feed element that is grounded to the grounding plate via a second feed point. The first feed point and the second feed point are disposed such that a straight line connecting the first feed point and a center of the grounding plate and a straight line connecting the second feed point and the center of the grounding plate are substantially perpendicular to each other in a plan view.

14 Claims, 9 Drawing Sheets

MULTI-ANTENNA DEVICE AND COMMUNICATION DEVICE

CROSS-REFERENCE TO RELATED APPLICATIONS

This application claims priority to Japanese Patent Application No. 2012-254225 filed on Nov. 20, 2012. The entire disclosure of Japanese Patent Application No. 2012-254225 is hereby incorporated herein by reference.

BACKGROUND

1. Field of the Invention

The present invention generally relates to a multi-antenna device and a communication device. More specifically, the present invention relates to a multi-antenna device and a communication device having a plurality of antennas.

2. Background Information

A multi-antenna device equipped with a plurality of antennas was known in the past (see Japanese Unexamined Patent Application Publication (Translation of PCT Application) No. JP2010-525680 (Patent Literature 1), for example).

The above-mentioned Patent Literature 1 discloses a multi-mode antenna structure (multi-antenna device) with which a connector element is provided for electrically connecting two antennas together between the two antennas, which reduces cross coupling between the two antennas at a specific frequency.

SUMMARY

However, although it is possible to reduce cross coupling between the two antennas at a specific frequency with the multi-mode antenna structure (multi-antenna device) in Patent Literature 1, it has been discovered that there connector elements have frequency characteristics that make it difficult to obtain performance for reducing cross coupling outside of the specific frequency. Thus, when the two antennas are compatible with a wide frequency band, it is difficult to maintain broadband performance while still reducing cross coupling between the two antennas over the entire corresponding frequency band. A "wide frequency band" generally refers to a band in which the ratio between the maximum and minimum usable frequencies is about 1.2 times.

One object of the present disclosure is to provide a multi-antenna device with which broadband performance can be maintained while cross coupling between antennas is reduced. Another object of the present disclosure is to provide a communication device including such a multi-antenna device.

In view of the state of the know technology, a multi-antenna device includes a grounding plate, a first antenna and a second antenna. The first antenna includes a first feed element that is grounded to the grounding plate via a first feed point. The second antenna includes a second feed element that is grounded to the grounding plate via a second feed point. The first feed point and the second feed point are disposed such that a straight line connecting the first feed point and a center of the grounding plate and a straight line connecting the second feed point and the center of the grounding plate are substantially perpendicular to each other in a plan view.

Other objects, features, aspects and advantages of the present disclosure will become apparent to those skilled in the art from the following detailed description, which, taken in conjunction with the annexed drawings, discloses a preferred embodiment of a multi-antenna device and a communication device.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

First Embodiment

Referring initially to FIGS. 1 to 6, a portable telephone 100 is illustrated in accordance with a first embodiment. The portable telephone 100 is an example of the "communication device" of the present invention.

Figure 1:
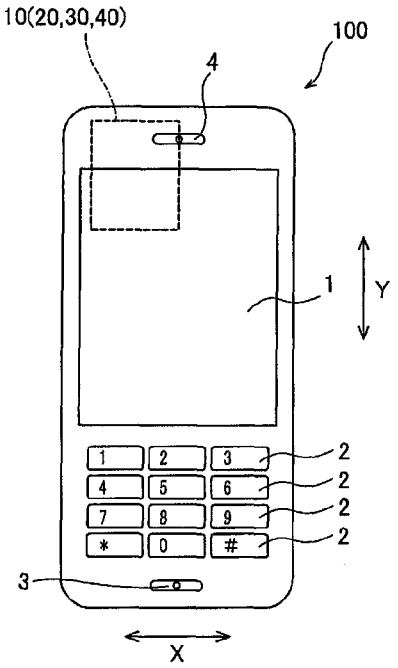
FIG. 1 is an oblique view of the overall configuration of a portable telephone pertaining to the first to fourth embodiments of the present invention.

As shown in FIG. 1, the portable telephone 100 pertaining to the first embodiment has a substantially rectangular shape when viewed from the front. The portable telephone 100 includes a display screen component 1, an interface component 2 having number buttons or the like, a microphone 3, and a speaker 4. A multi-antenna device 10 is provided inside the housing of the portable telephone 100.

The multi-antenna device 10 is configured for use in MIMO (multiple-input and multiple-output) communication that allows multiplexed input and output using a plurality of antennas. The multi-antenna device 10 is compatible with ultra wide band (a band in which the ratio between the maximum and minimum usable frequencies is at least about 1.5 times), so as to be compatible with WiMAX (worldwide interoperability for microwave access) of high-speed wireless communication networks of a plurality of frequency bands (2.3 GHz, 2.6 GHz, and 3.5 GHz).

Figure 2:
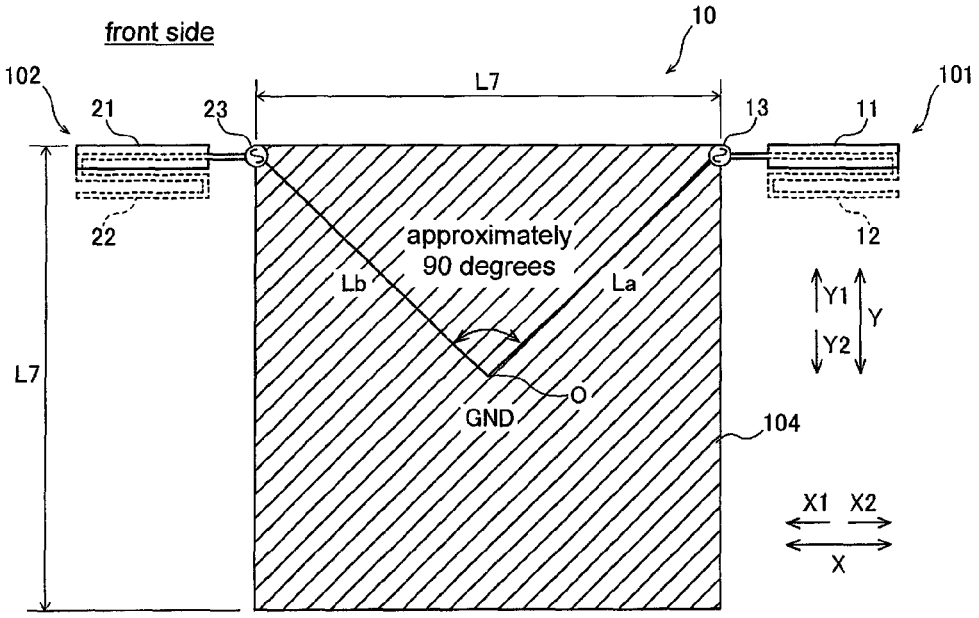
FIG. 2 is a diagram of the multi-antenna device in the portable telephone pertaining to the first embodiment of the present invention, as seen from the front side.
Figure 3:
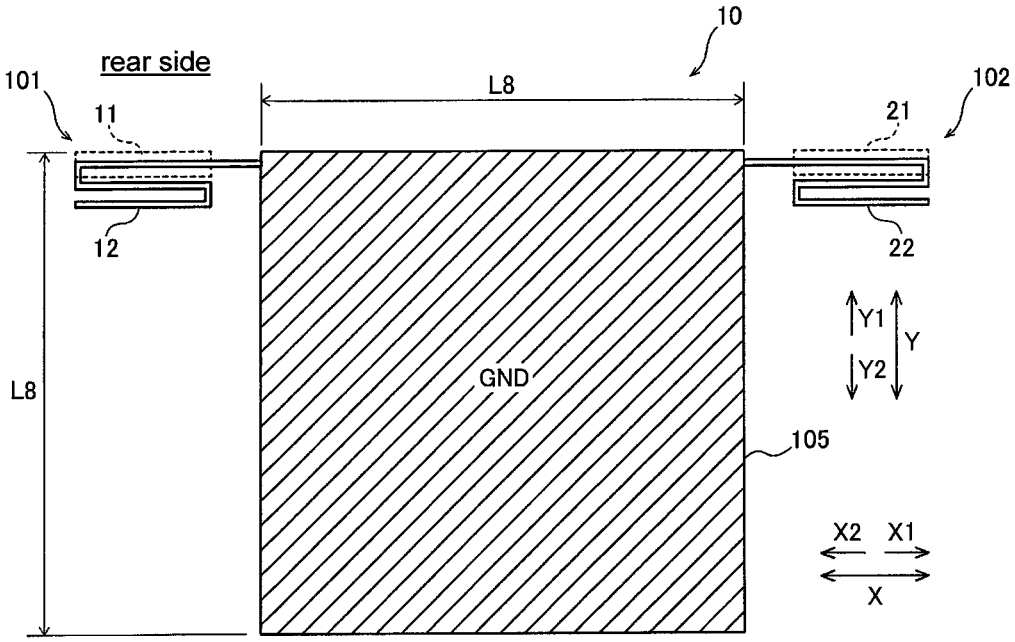
FIG. 3 is a diagram of the multi-antenna device in the portable telephone pertaining to the first embodiment of the present invention, as seen from the rear side.

More specifically, as shown in FIGS. 2 and 3, the multi-antenna device 10 includes a first antenna 101, a second antenna 102, a board 103 (see FIG. 6) on which the first antenna 101 and the second antenna 102 are disposed, and a first grounding plate 104 (see FIG. 2) and a second grounding plate 105 (see FIG. 3) respectively disposed on the front (the surface on the Z1 direction side) and the rear (the surface on the Z2 direction side) of the board 103. The board 103 is 1 mm thick, and is made of a glass epoxy resin. The first grounding plate 104 and the second grounding plate 105 are both the same size and have a square shape, and are disposed so as to overlap each other. The first antenna 101 and the second antenna 102 are each disposed near the two mutually adjacent vertices of the square grounding plate 104 (105). Also, the first antenna 101 and the second antenna 102 are formed in shapes that are in linear symmetry to each other in the X direction (a shape in which the X1 direction and the X2 direction are switched).

The first antenna 101 (second antenna 102) has a feed element 11 (21) that is grounded to the first grounding plate 104, and a passive element 12 (22) that is grounded to the second grounding plate 105. As shown in FIG. 2, the feed element 11 (21) of the first antenna 101 (second antenna 102) is disposed on the front (the surface on the Z1 direction side) of the board 103 (see FIG. 6), and is grounded to the first grounding plate 104 via a first feed point 13 (second feed point 23) that supplies high-frequency power to the feed element 11 (21). As shown in FIG. 3, the passive element 12 (22) of the first antenna 101 (second antenna 102) is disposed on the rear (the surface on the Z2 direction side) of the board 103 (see FIG. 6), and is grounded to the second grounding plate 105. The feed elements 11 and 21 are examples of the "first feed element" and "second feed element" of the present invention, respectively. The passive elements 12 and 22 are examples of the "first passive element" and "second passive element" of the present invention, respectively. The first grounding plate 104 is an example of the "grounding plate" of the present invention.

As shown in FIG. 2, in the first embodiment, the first feed point 13 of the first antenna 101 and the second feed point 23 of the second antenna 102 are disposed such that a straight line La linking the center O of the first grounding plate 104 and the first feed point 13 and a straight line Lb linking the center O of the first grounding plate 104 and the second feed point 23 are substantially perpendicular to each other (intersect at approximately 90 degrees (a range of from approximately 84 degrees or more to approximately 96 degrees or less)). For example, the straight lines La and Lb can intersect at the right angle (90 degrees). However, the angle between the straight lines La and Lb can also intersect at an angle of between 84 degrees and 96 degrees. The first feed point 13 and the second feed point 23 are also disposed on the outer edge of the first grounding plate 104. More specifically, the first feed point 13 and the second feed point 23 are disposed on the outer edge near the mutually adjacent vertices of the first grounding plate 104. Therefore, of the outer edges of the first grounding plate 104 between the first feed point 13 and the second feed point 23, the length of the smaller one (the closer one) is substantially equal to the length L7 of one side of the square first grounding plate 104. Meanwhile, of the outer edges of the first grounding plate 104 between the first feed point 13 and the second feed point 23, the length of the longer one (the farther one) is substantially equal to the length of the three sides of the first grounding plate 104 (a length three times that of L7). As discussed below, the length L7 of one side of the first grounding plate 104 is an electrical length of approximately one-half the wavelength λ corresponding to the frequency in the approximate middle of the ultra wide band frequency that can be used at which the VSWR (voltage standing wave ratio) is 2 or less. Specifically, the first feed point 13 and the second feed point 23 are disposed spaced apart by an electrical length that is approximately one-half the wavelength λ, corresponding to the frequency in the approximate middle of the ultra wide band frequency at which the VSWR is 2 or less.

Figure 4:
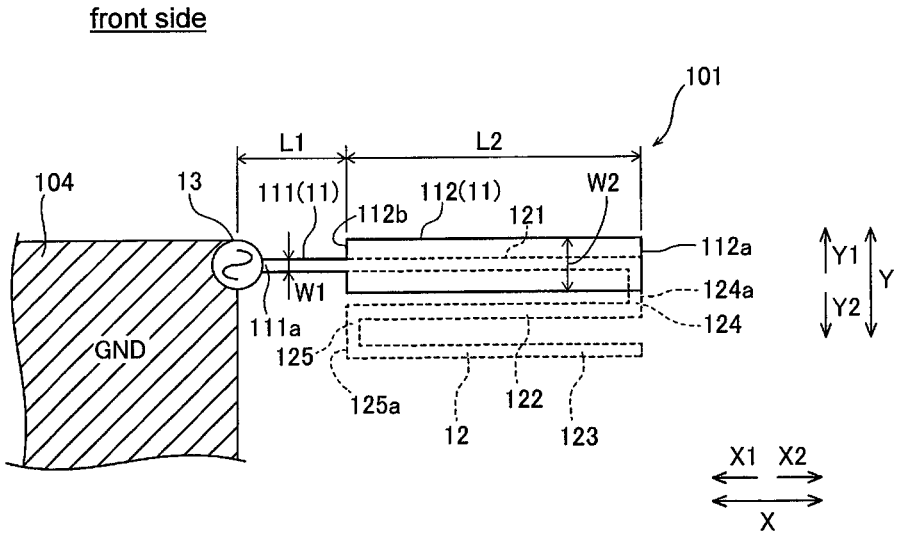
FIG. 4 is a detail view of the first antenna of the multi-antenna device in the portable telephone pertaining to the first embodiment of the present invention, as seen from the front side.
Figure 6:
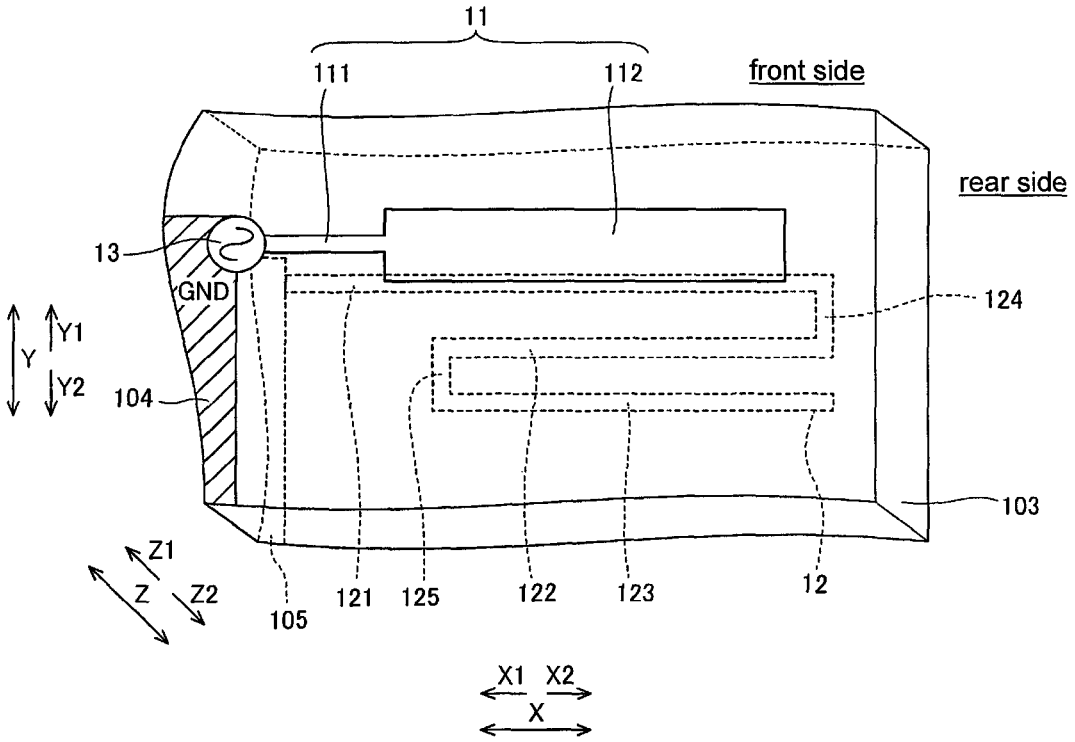
FIG. 6 is an oblique view of the first antenna of the multi-antenna device in the portable telephone pertaining to the first embodiment of the present invention.

Next, the feed element 11 and passive element 12 of the first antenna 101 will be described in detail. The feed element 11 and the passive element 12 are each made of a conductor and are in the form of a thin plate. As shown in FIGS. 4 and 6, the feed element 11 is formed in a linear shape so as to extend in the X direction. The feed element 11 includes a first portion 111 located on the X1 direction side, and a second portion 112 located on the X2 direction side. The first portion 111 and the second portion 112 have a substantially rectangular shape in plan view, and are formed so as to extend in the X direction. One end 111*a* of the first portion 111 of the feed element 11 (the end in the X1 direction) is connected to the first grounding plate 104 via the first feed point 13, and one end 112*a* of the second portion 112 (the end in the X2 direction) is open.

The width W1 of the first portion 111 of the feed element 11 in the Y direction (a direction that is perpendicular to the direction in which the feed element 11 extends) is 0.4 mm. The width W2 of the second portion 112 of the feed element 11 is greater than the width W1 of the first portion 111, and is 1.2 mm. That is, the ratio of the width W1 of the first portion 111 to the width W2 of the second portion 112 is 3 times. The length L1 the first portion 111 of the feed element 11 in the X direction (the direction in which the feed element 11 extends)

is 3.2 mm. The length L2 of the second portion 112 of the feed element 11 in the X direction is greater than the length L1 of the first portion 111, and is 8.8 mm. That is, the length (L1+L2) from the one end 111*a* of the first portion 111 of the feed element 11 to the one end 112*a* of the second portion 112 of the feed element 11 is 12.0 mm, and the ratio of the length L1 of the first portion 111 to the length L2 of the second portion 112 is 2.75 times.

The feed element 11 is configured so as to couple with the entire passive element 12. More specifically, the first portion 111 and second portion 112 of the feed element 11 each couple with the entire passive element 12. That is, the first portion 111 and second portion 112 of the feed element 11 couple with a first linear part 121, a second linear part 122, a third linear part 123, a first linking part 124, and a second linking part 125 of the passive element 12 (all discussed below). The second portion 112 couples with the passive element 12 more strongly than the first portion 111 does. The term "coupling" here is a broad concept that encompasses both electrostatic coupling and magnetic field coupling.

Figure 5:
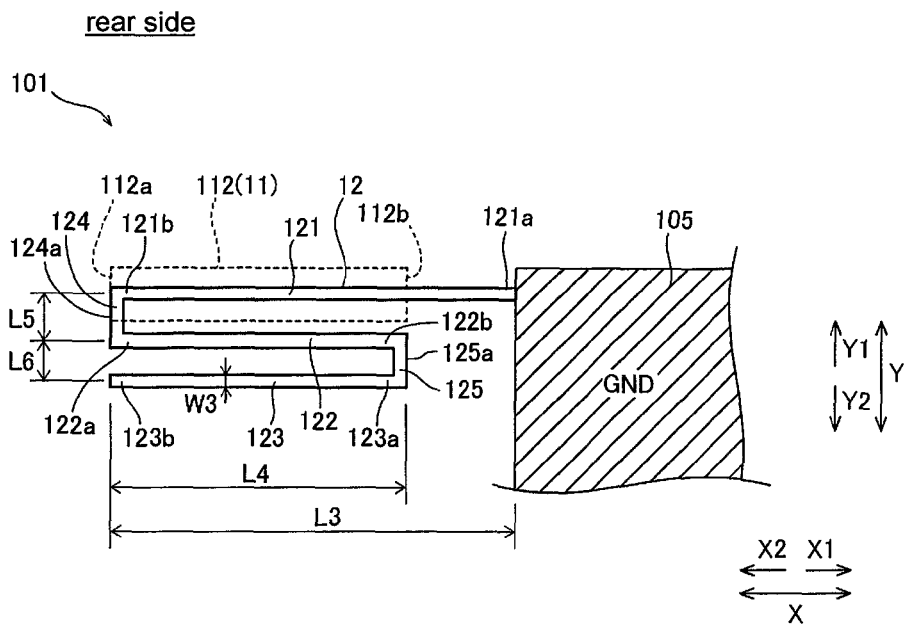
FIG. 5 is a detail view of the first antenna of the multi-antenna device in the portable telephone pertaining to the first embodiment of the present invention, as seen from the rear side.

As shown in FIGS. 5 and 6, the passive element 12 has a meandering shape (zigzag shape) that curves at a plurality of locations when viewed overall. The passive element 12 also includes the first linear part 121, the second linear part 122, and the third linear part 123, which are formed so as to extend in the X direction. The passive element 12 further includes the first linking part 124, which is formed so as to extend in the Y direction linking the first linear part 121 and the second linear part 122, and the second linking part 125, which is formed so as to extend in the Y direction linking the second linear part 122 and the third linear part 123. The first linear part 121, the second linear part 122, the third linear part 123, the first linking part 124, and the second linking part 125 are examples of the "folded-back parts" of the present invention.

One end 121*a* of the first linear part 121 of the passive element 12 (the end in the X1 direction) is grounded near the vertex of the second grounding plate 105. The other end 121*b* of the first linear part 121 of the passive element 12 (the end in the X2 direction) and one end 122*a* of the second linear part 122 (the end in the X2 direction) are linked so as to be folded back by the first linking part 124. Also, the other end 122*b* of the second linear part 122 of the passive element 12 (the end in the X1 direction) and one end 123*a* of the third linear part 123 (the end in the X1 direction) are linked so as to be folded back by the second linking part 125. The other end 123*b* of the third linear part 123 of the passive element 12 (the end in the X2 direction) is open.

As shown in FIGS. 4 and 5, the first portion 111 of the feed element 11 is disposed so as to overlap the first linear part 121 of the passive element 12 in plan view. The second portion 112 of the feed element 11 is disposed so as to overlap the first linear part 121 and the first linking part 124 of the passive element 12. The position of the one end 112*a* (e.g., a furthermost end) of the second portion 112 of the feed element 11 (the end in the X2 direction) coincides with (or aligned to) the end 124*a* (e.g., a furthermost end) in the X2 direction of the first linking part 124 of the passive element 12 in the X direction. The position of the other end 112*b* of the second portion 112 of the feed element 11 (the end in the X1 direction) coincides with the end 125*a* in the X1 direction of the second linking part 125 of the passive element 12 in the X direction.

As shown in FIG. 5, the length L3 in the X direction of the first linear part 121 of the passive element 12 is 12.0 mm, and is equal to the length (L1+L2) in the X direction of the first portion 111 and the second portion 112 of the feed element 11 (see FIG. 4). The length L4 in the X direction of the second linear part 122 and the third linear part 123 of the passive element 12 is equal to the length L2 in the X direction of the second portion 112 of the feed element 11, and is 8.8 mm.

The width W3 of the passive element 12 in a direction that is perpendicular to the direction in which the first linear part 121, the second linear part 122, the third linear part 123, the first linking part 124, and the second linking part 125 extend is 0.4 mm, and the width is uniform over the entire passive element 12. The width W3 of the passive element 12 is equal to the width W1 of the first portion 111 of the feed element 11 in the Y direction (see FIG. 4), and is less than the width W2 of the second portion 112 of the feed element 11 in the Y direction (see FIG. 4).

The first linear part 121, the second linear part 122, and the third linear part 123 are disposed parallel to each other, and the first linking part 124 and the second linking part 125 are disposed parallel to each other. The first linear part 121 and second linear part 122 of the passive element 12 are disposed spaced apart by a center spacing L5 (1.4 mm), and the second linear part 122 and the third linear part 123 are disposed spaced apart by a center spacing L6 (1.2 mm).

As discussed above, the second antenna 102 has a shape that is in linear symmetry with the first antenna 101 (a shape in which the X1 direction and the X2 direction are switched) in the X direction, and a feed element 21, a passive element 22, and the second feed point 23 of the second antenna 102 respectively correspond to the feed element 11, the passive element 12, and the first feed point 13 of the first antenna 101. The second antenna 102 will not be described in detail.

Because the first grounding plate 104 is formed in a square shape in plan view, it has a shape that is in point symmetry with the center O of the first grounding plate 104. The length L7 of one side of the first grounding plate 104 is an electrical length of approximately one-half the wavelength λ corresponding to the frequency in the approximate middle of the ultra wide band frequency that can be used at which the VSWR (voltage standing wave ratio) is 2 or less. With the multi-antenna device 10 in the first embodiment, as is clear from the results of the simulation discussed below, the VSWR is 2 or less in an ultra wide frequency band of from approximately 2.1 GHz or more to approximately 4.08 GHz or less, and the frequency in the approximate middle is 3.0 GHz. The length L7 of one side of the first grounding plate 104 is set to 33 mm, which is an electrical length of approximately one-half the wavelength λ corresponding to the frequency in the middle (3.0 GHz). The length L8 of one side of the second grounding plate 105, which has a square shape, is 33 mm, which is the same as that of the first grounding plate 104.

In the first embodiment, as discussed above, the first feed point 13 and the second feed point 23 are disposed such that a straight line La connecting the first feed point 13 of the first antenna 101 and the center O of the first grounding plate 104 and a straight line Lb connecting the second feed point 23 of the second antenna 102 and the center O of the first grounding plate 104 are substantially perpendicular to each other in plan view, the result being that ultra broadband performance can be maintained while reducing cross coupling between antennas over the entire corresponding ultra wide frequency band.

Also, in the first embodiment, the first grounding plate 104 is formed in a shape that is in point symmetry with the center O of the first grounding plate 104. Consequently, broadband performance can be maintained while effectively reducing cross coupling between antennas.

In the first embodiment, the first grounding plate 104 is formed in a square shape in plan view, and the first feed point 13 and the second feed point 23 are disposed near the vertices of the first grounding plate 104. Consequently, the sides constituting the vertices of the first grounding plate 104 where the first feed point 13 and the second feed point 23 are disposed can function as an antenna, which effectively raises the emission efficiency. Also, the first grounding plate 104, which is in a square shape that is relatively easy to install, can be used to maintain broadband performance while effectively reducing cross coupling between antennas.

Also, in the first embodiment, the first feed point 13 and the second feed point 23 are disposed such that the length L7 of the outer edge of the first grounding plate 104 between the first feed point 13 and the second feed point 23 will be an electrical length of approximately one-half the wavelength λ corresponding to the frequency in the approximate middle of the frequency band at which the VSWR is 2 or less. Consequently, the distance between the first feed point 13 and second feed point 23 will not be as large, while cross coupling between the antennas can be effectively reduced over the entire corresponding wide frequency band, so a more compact multi-antenna device 10 can be achieved, while effectively reducing cross coupling between the antennas over the corresponding wide frequency band.

Also, in the first embodiment, the feed element 11 and the feed element 21 are respectively provided with the first portion 111 and the second portion 112, which is wider than the first portion 111, the widths W2 of the second portions 112 of the feed element 11 and the feed element 21 are each greater than the width W3 of the passive element 12 and the passive element 22 in a direction perpendicular to the direction in which the plurality of folded-back parts extend, and the second portion 112 of the feed element 11 and the feed element 21 are coupled with the plurality of folded-back parts of the passive element 12 and the passive element 22. Consequently, the folded-back parts of the passive element 12 (22) and the second portion 112 of the feed element 11 (21) are coupled, which affords compatibility with an ultra wide band (a band in which the ratio between the maximum and minimum usable frequencies is approximately 1.5 or more), while reducing cross coupling between antennas. Also, since the necessary length ca be ensured for the passive element 12 (22) by the plurality of folded-back parts, there is no need to expand the area in which the passive element 12 (22) is installed, and as a result a more compact multi-antenna device 10 can be achieved.

Also, in the first embodiment, the one end 121*a* of the passive element 12 (22) is grounded to the first grounding plate 104, and the other end 123*b* is open. Consequently, the passive element 12 (22) grounded to the first grounding plate 104 can be coupled with the second portion 112 of the feed element 11 (21), affording easy compatibility with an ultra wide frequency band.

Also, in the first embodiment, the feed element 11 and the feed element 21 are respectively disposed overlapping the passive element 12 and the passive element 22 in plan view. Consequently, the feed element 11 (21) and the passive element 12 (22) can be overlapped in plan view in the first antenna 101 and the second antenna 102, respectively, allowing the planar area in which the feed element 11 (21) and the passive element 12 (22) are installed to be made smaller, so a more compact multi-antenna device 10 can be easily achieved.

Figure 7:
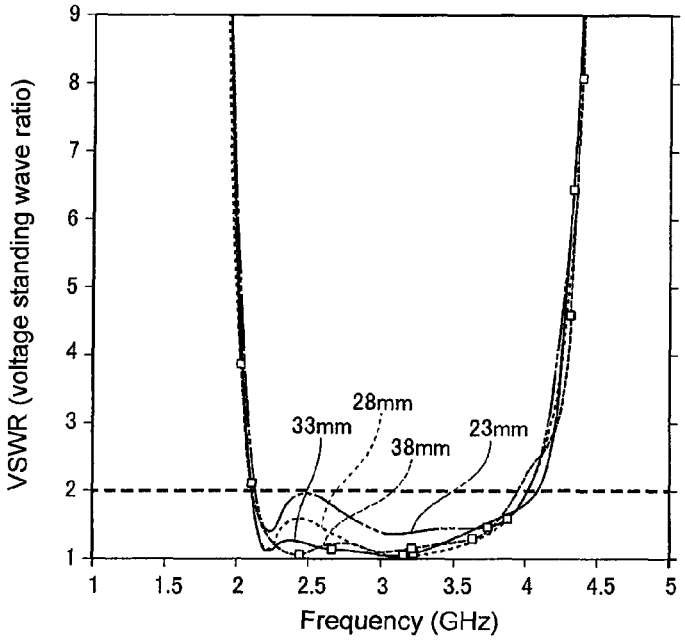
FIG. 7 is a graph of the relation between VSWR and frequency in a simulation of the multi-antenna device in the portable telephone pertaining to the first embodiment of the present invention.
Figure 8:
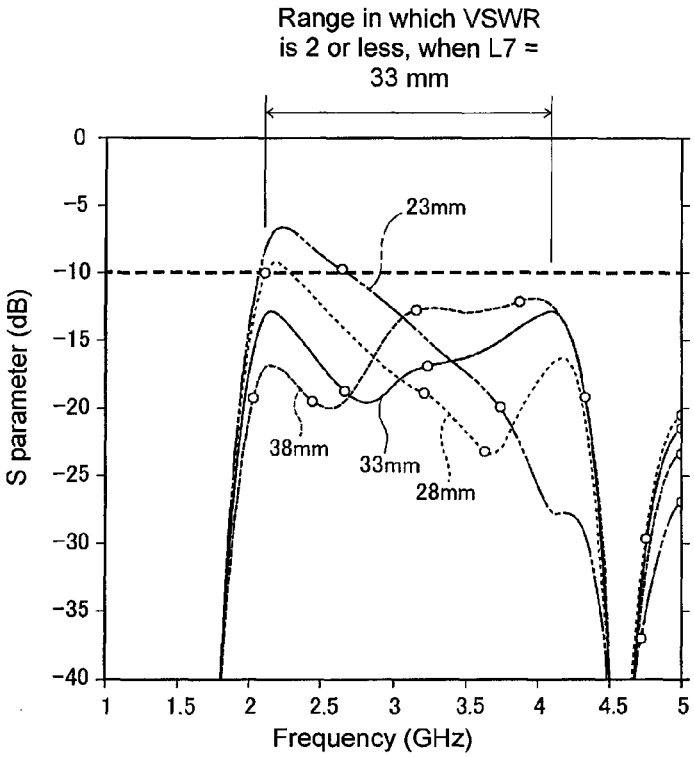
FIG. 8 is a graph of the relation between the S parameter (S12) and frequency in a simulation of the multi-antenna device in the portable telephone pertaining to the first embodiment of the present invention.

Next, we will describe the results of a simulation conducted in order to confirm the effect of the first embodiment above. As shown in FIG. 7, in this simulation, the relation (frequency characteristics) between the frequency and the VSWR (voltage standing wave ratio) of the multi-antenna device 10 produced in the first embodiment (in which the length L7 of one side of the first grounding plate 104 was 33 mm). As shown in FIG. 8, the relation (frequency characteristics) between the S parameter and frequency in the multi-antenna device 10 produced in the first embodiment was also obtained.

In the simulation results shown in FIG. 7, the horizontal axis is frequency (GHz), and the vertical axis is the VSWR (voltage standing wave ratio). In FIG. 7, for the sake of comparison, results are also shown for when the length L7 of one side of the first grounding plate 104 was changed to 23 mm, 28 mm, and 38 mm. It is believed that good antenna characteristics will result as long as the VSWR is 2 or less.

First, with the multi-antenna device 10 produced in the first embodiment (in which the length L7 of one side of the first grounding plate 104 was 33 mm), the minimum frequency for a range in which the VSWR was 2 or less was approximately 2.1 GHz. The maximum frequency for a range in which the VSWR was 2 or less was approximately 4.08 GHz. Specifically, the ratio between the minimum frequency (2.1 GHz) and the maximum frequency (4.08 GHz) for a range in which the VSWR was 2 or less was approximately 1.94 times, and regarding VSWR characteristics, the multi-antenna device 10 produced in the first embodiment was found to be compatible with an ultra wide frequency band.

Next, when the length L7 of one side of the first grounding plate 104 was 23 mm, the minimum frequency for a range in which the VSWR was 2 or less was approximately 2.1 GHz. The maximum frequency for a range in which the VSWR was 2 or less was approximately 4.0 GHz. Specifically, the ratio between the minimum frequency (2.1 GHz) and the maximum frequency (4.0 GHz) for a range in which the VSWR was 2 or less was approximately 1.9 times, and regarding VSWR characteristics, it was found that there was compatibility with an ultra wide frequency band even when the length L7 of one side of the first grounding plate 104 was 23 mm.

When the length L7 of one side of the first grounding plate 104 was 28 mm, just as the length when L7 was 23 mm, the minimum frequency for a range in which the VSWR was 2 or less was approximately 2.1 GHz and the maximum frequency was approximately 4.0 GHz. Specifically, the ratio between the minimum frequency (2.1 GHz) and the maximum frequency (4.0 GHz) for a range in which the VSWR was 2 or less was approximately 1.9 times, and regarding VSWR characteristics, it was found that there was compatibility with an ultra wide frequency band even when the length L7 of one side of the first grounding plate 104 was 28 mm.

When the length L7 of one side of the first grounding plate 104 was 38 mm, the minimum frequency for a range in which the VSWR was 2 or less was approximately 2.1 GHz and the maximum frequency was approximately 3.9 GHz. Specifically, the ratio between the minimum frequency (2.1 GHz) and the maximum frequency (3.9 GHz) for a range in which the VSWR was 2 or less was approximately 1.86 times, and regarding VSWR characteristics, it was found that there was compatibility with an ultra wide frequency band even when the length L7 of one side of the first grounding plate 104 was 38 mm.

In the simulation results shown in FIG. 8, the horizontal axis is frequency (GHz), and the vertical axis is S12 as the S parameter. S12 means the strength of cross coupling between two antennas (the first antenna 101 and the second antenna 102). In FIG. 8, just as with the VSWR, for the sake of comparison, results are also shown for when the length L7 of one side of the first grounding plate 104 was changed to 23 mm, 28 mm, and 38 mm. It is believed that cross coupling between two antennas will be minimal as long as S12 is −10 dB or less.

First, with the multi-antenna device 10 produced in the first embodiment (in which the length L7 of one side of the first grounding plate 104 was 33 mm), it was confirmed that S12 was −10 dB or less over the entire range in which the VSWR was 2 or less (from approximately 2.1 GHz or more to approximately 4.08 GHz or less). Specifically, with the configuration of the multi-antenna device 10 pertaining to the first embodiment, it was confirmed that the VSWR could be lowered to 2 or less, and S12 to −10 dB or less, in an ultra wide frequency band (approximately 2.1 GHz or more, and approximately 4.08 GHz or less; in which the ratio between the maximum and minimum frequencies is about 1.94 times).

Next, it was confirmed that when the length L7 of one side of the first grounding plate 104 was 23 mm, with a range in which the VSWR was 2 or less (approximately 2.1 GHz or more, and approximately 4.0 or less), S12 was −10 dB or less in a range of approximately 2.75 GHz or more. Specifically, with a configuration in which the length L7 of one side of the first grounding plate 104 is 23 mm, it was confirmed that the VSWR could be lowered to 2 or less, and S12 to −10 dB or less, in a wide frequency band (approximately 2.75 GHz or more, and approximately 4.0 GHz or less; in which the ratio between the maximum and minimum frequencies is about 1.45 times).

When the length L7 of one side of the first grounding plate 104 was 28 mm, with a range in which the VSWR was 2 or less (approximately 2.1 GHz or more, and approximately 4.0 or less), it was confirmed that S12 was −10 dB or less in a range of approximately 2.3 GHz or more. Specifically, with a configuration in which the length L7 of one side of the first grounding plate 104 is 28 mm, it was confirmed that the VSWR could be lowered to 2 or less, and S12 to −10 dB or less, in an ultra wide frequency band (approximately 2.3 GHz or more, and approximately 4.0 GHz or less; in which the ratio between the maximum and minimum frequencies is about 1.74 times).

When the length L7 of one side of the first grounding plate 104 was 38 mm, it was confirmed that S12 was −10 dB or less in over the entire range in which the VSWR was 2 or less (approximately 2.1 GHz or more, and approximately 3.9 or less). Specifically, with a configuration in which the length L7 of one side of the first grounding plate 104 is 38 mm, it was confirmed that the VSWR could be lowered to 2 or less, and S12 to −10 dB or less, in an ultra wide frequency band (approximately 2.1 GHz or more, and approximately 3.9 GHz or less; in which the ratio between the maximum and minimum frequencies is about 1.86 times).

It was confirmed from the above results that if the first feed point 13 and the second feed point 23 are disposed such that a straight line La linking the center O of the first grounding plate 104 and the first feed point 13 of the first antenna 101 and a straight line Lb linking the center O of the first grounding plate 104 and the second feed point 23 of the second antenna 102 are substantially perpendicular to each other in plan view, then broadband performance can be maintained while reducing cross coupling between antennas.

The reason for this is believed to be as follows. If the straight line La linking the center O of the first grounding plate 104 and the first feed point 13 of the first antenna 101 and the straight line Lb linking the center O of the first grounding plate 104 and the second feed point 23 of the second antenna 102 are substantially perpendicular to each other in plan view, it is believed that the polarization planes formed by two antennas will be substantially perpendicular to each other, and there will be less cross coupling between the antennas.

Second Embodiment

Next, a multi-antenna device 20 pertaining to a second embodiment will be described through reference to FIG. 9. In this second embodiment, the configuration differs from that in the first embodiment above in that a first grounding plate 204 and a second grounding plate 205 are formed in a circular shape. In view of the similarity between the first and second embodiments, the parts of the second embodiment that are structurally or functionally identical to the parts of the first embodiment will be given the same reference numerals as the parts of the first embodiment.

Figure 9:
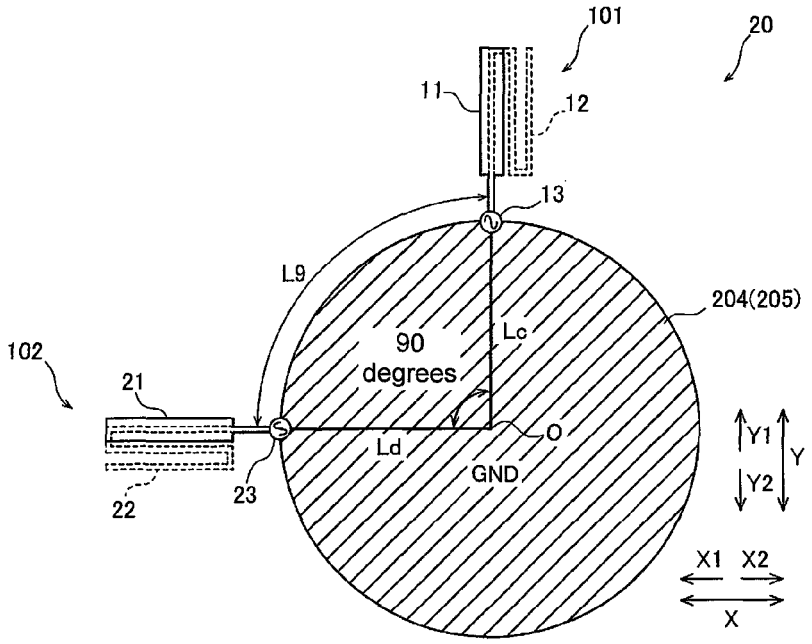
FIG. 9 is a diagram of the multi-antenna device in the portable telephone pertaining to a second embodiment of the present invention, as seen from the front side.

As shown in FIG. 9, the first grounding plate 204 of the multi-antenna device 20 pertaining to the second embodiment is formed in a circular shape in plan view, and has a shape that is in point symmetry with the center O of the first grounding plate 204. The second grounding plate 205 is formed in the same shape as the first grounding plate 204, and is disposed so as to overlap with the first grounding plate 204 in plan view. The first feed point 13 of the first antenna 101 and the second feed point 23 of the second antenna 102 are disposed such that a straight line Lc connecting the first feed point 13 and the center O of the first grounding plate 204 and a straight line Ld connecting the second feed point 23 and the center O of the first grounding plate 204 are substantially perpendicular to each other in plan view (intersect at 90 degrees). Also, the first feed point 13 and the second feed point 23 are disposed on the outer edge of the first grounding plate 204. Accordingly, of the outer edges of the first grounding plate 204 between the first feed point 13 and the second feed point 23, the length L9 of the smaller (closer) edge (the length of the arc) is a length that is one-third the length of the larger (farther) edge. The length L9 of the outer edge of the first grounding plate 204 between the first feed point 13 and the second feed point 23 is also an electrical length of approximately one-half the wavelength λ corresponding to a frequency substantially in the middle of the usable ultra wide frequency band at which the VSWR (voltage standing wave ratio) is 2 or less.

The rest of the configuration in the second embodiment is the same as in the first embodiment above.

In the second embodiment, as discussed above, since the first feed point 13 and the second feed point 23 are disposed such that the straight line Lc connecting the first feed point 13 of the first antenna 101 and the center O of the first grounding plate 204 and the straight line Ld connecting the second feed point 23 of the second antenna 102 and the center O of the first grounding plate 204 are substantially perpendicular to each other in plan view, ultra broadband performance can be maintained while reducing cross coupling between antennas over the entire corresponding ultra wide frequency band.

The rest of the effect of the second embodiment is the same as that of the first embodiment above.

Third Embodiment

Next, a multi-antenna device 30 pertaining to a third embodiment will be described through reference to FIG. 10. In this third embodiment, the configuration differs from that in the first embodiment above in that a first grounding plate 304 and a second grounding plate 305 are formed in a regular octagonal shape. In view of the similarity between the first and third embodiments, the parts of the third embodiment that are structurally or functionally identical to the parts of the first embodiment will be given the same reference numerals as the parts of the first embodiment.

Figure 10:
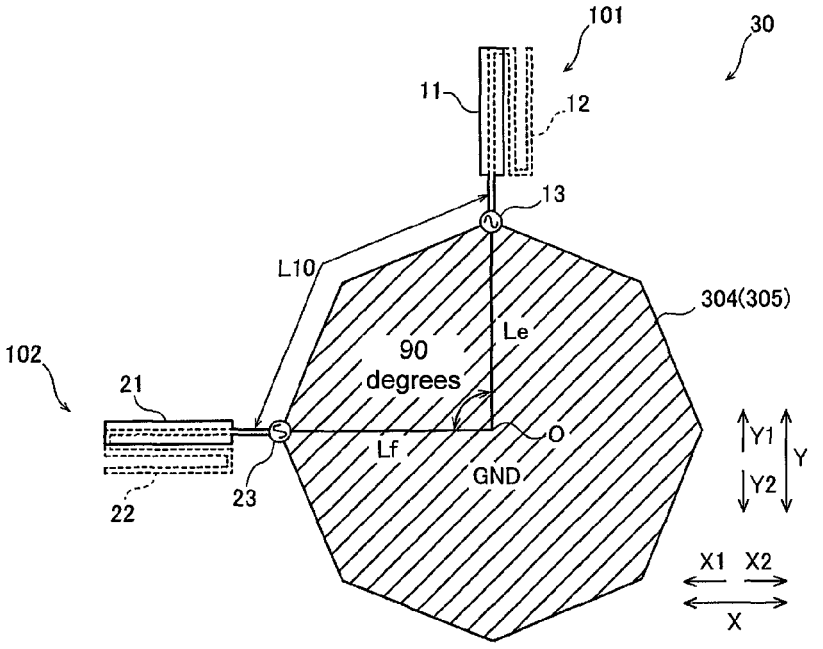
FIG. 10 is a diagram of the multi-antenna device in the portable telephone pertaining to a third embodiment of the present invention, as seen from the front side.

As shown in FIG. 10, the first grounding plate 304 of the multi-antenna device 30 pertaining to the third embodiment is formed in a regular octagonal shape in plan view, and has a shape that is in point symmetry with the center O of the first grounding plate 304. The second grounding plate 305 is formed in the same shape as the first grounding plate 304, and is disposed so as to overlap with the first grounding plate 304 in plan view. The first feed point 13 of the first antenna 101 and the second feed point 23 of the second antenna 102 are disposed such that a straight line Le connecting the first feed point 13 and the center O of the first grounding plate 304 and a straight line Lf connecting the second feed point 23 and the center O of the first grounding plate 304 are substantially perpendicular to each other in plan view (intersect at 90 degrees). Also, the first feed point 13 and the second feed point 23 are disposed on the outer edge of the first grounding plate 304. More specifically, the first feed point 13 and the second feed point 23 are disposed near the vertices of the first grounding plate 304. Accordingly, of the outer edges of the first grounding plate 304 between the first feed point 13 and the second feed point 23, the length L10 of the smaller (closer) edges (the length of two sides of the first grounding plate 304) is a length that is one-third the length of the larger (farther) edges. The length L10 of the outer edges of the first grounding plate 304 between the first feed point 13 and the second feed point 23 is also an electrical length of approximately one-half the wavelength λ corresponding to a frequency substantially in the middle of the usable ultra wide frequency band at which the VSWR (voltage standing wave ratio) is 2 or less.

The rest of the configuration in the third embodiment is the same as in the first embodiment above.

In the third embodiment, as discussed above, since the first feed point 13 and the second feed point 23 are disposed such that the straight line Le connecting the first feed point 13 of the first antenna 101 and the center O of the first grounding plate 304 and the straight line Lf connecting the second feed point 23 of the second antenna 102 and the center O of the first grounding plate 304 are substantially perpendicular to each other in plan view, ultra broadband performance can be maintained while reducing cross coupling between antennas over the entire corresponding ultra wide frequency band.

The rest of the effect of the third embodiment is the same as that of the first embodiment above.

Fourth Embodiment

Next, a multi-antenna device 40 pertaining to a fourth embodiment will be described through reference to FIG. 11. In this fourth embodiment, the configuration differs from that in the first embodiment above in that a third linking part 126 is linked to the third linear part 123 of the passive element 12, and a fourth linear part 127 is linked to the third linking part 126. The third linking part 126 and the fourth linear part 127 are examples of the folded-back part" of the present invention. In view of the similarity between the first and fourth embodiments, the parts of the fourth embodiment that are structurally or functionally identical to the parts of the first embodiment will be given the same reference numerals as the parts of the first embodiment.

Figure 11:
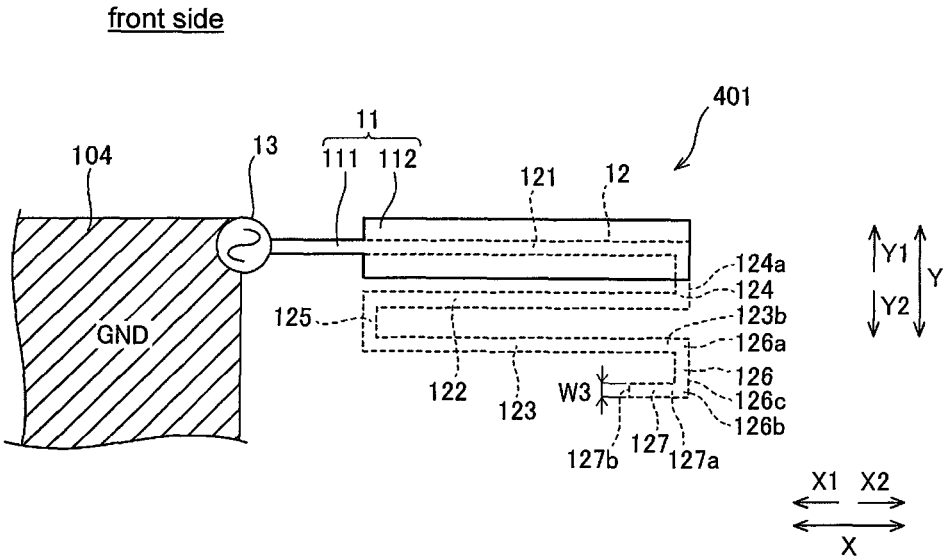
FIG. 11 is a detail view of the first antenna of the multi-antenna device in the portable telephone pertaining to a fourth embodiment of the present invention, as seen from the front side.

As shown in FIG. 11, in the fourth embodiment, the first antenna 401 of the multi-antenna device 40 includes the third linking part 126 that is linked to the third linear part 123 of the passive element 12, and the fourth linear part 127 that is linked to the third linking part 126. The third linking part 126 is formed so as to extend in the Y direction. The fourth linear part 127 is formed so as to extend in the X direction. One end 126*a* of the third linking part 126 (the end in the Y1 direction) is linked to other end 123*b* of the third linear part 123 (the end in the X2 direction). Also, one end 127*a* of the fourth linear part 127 (the end in the X2 direction) is linked to the other end 126*b* of the third linking part 126 (the end in the Y2 direction). The other end 127*b* of the fourth linear part 127 (the end in the X1 direction) is open. The position of the end 126*c* in the X2 direction of the third linking part 126 coincides with the end 124*a* in the X2 direction of the first linking part 124 in the X direction.

The fourth linear part 127 is disposed parallel to the first linear part 121, the second linear part 122, and the third linear part 123. The fourth linear part 127 has a length that is approximately one-fourth or less of the length of the second linear part 122 and the third linear part 123 in the X direction, and is formed shorter than the length of the first linear part 121, the second linear part 122, and the third linear part 123. The third linking part 126 and the fourth linear part 127 have a width W3 of 0.4 mm, which is the same as that of the other portions of the passive element 12. Although not depicted in the drawings, a second antenna is formed in a shape that is in linear symmetry with the first antenna 401 in the X direction (a shape in which the X1 direction and the X2 direction are switched).

The rest of the configuration and effect of the fourth embodiment are the same as in the first embodiment above.

The embodiments disclosed herein are just examples in every respect, and should not be interpreted as being limiting in nature. The scope of the invention being indicated by the appended claims rather than by the above description of the embodiments, all modifications within the meaning and range of equivalency of the claims are included.

For example, in the first to fourth embodiments above, a portable telephone was given as an example of a communication device equipped with the multi-antenna device, but the present invention is not limited to or by this. For example, the present invention can also be applied to a communication device other than a portable telephone, such as a PDA (personal digital assistant), a notebook computer, an STB (set-top box), or the like that is equipped with a multi-antenna device.

Also, in the first to fourth embodiments above, a multi-antenna device for use in MIMO communication was given as an example of the multi-antenna device, but the present invention is not limited to or by this. For example, the present invention can also be applied to a multi-antenna device that is compatible with a format other than MIMO, such as diversity.

Also, in the first to fourth embodiments above, an example was given in which a multi-antenna device was compatible with WiMAX in the 2.3 GHz, 2.6 GHz, and 3.5 GHz bands, but the present invention is not limited to or by this. For example, the configuration can instead afford compatibility with a frequency other than those in the 2.3 GHz, 2.6 GHz, and 3.5 GHz bands, or to afford compatibility with a format other than WiMAX, such as GSM™ or 3G.

Also, in the first to fourth embodiments above, a feed element composed of a monopole antenna was given as an example of the feed element of the first antenna (second antenna), but the present invention is not limited to or by this. For example, the feed element can be something other than a monopole antenna, such as a dipole antenna.

Also, in the first to fourth embodiments above, an antenna having both a feed element and a passive element was given as an example of the first antenna (second antenna), but the present invention is not limited to or by this. The present invention can also include an antenna having no passive element, so long as the antenna has at least a feed element that is grounded to a grounding plate via a feed point.

Figure 12:
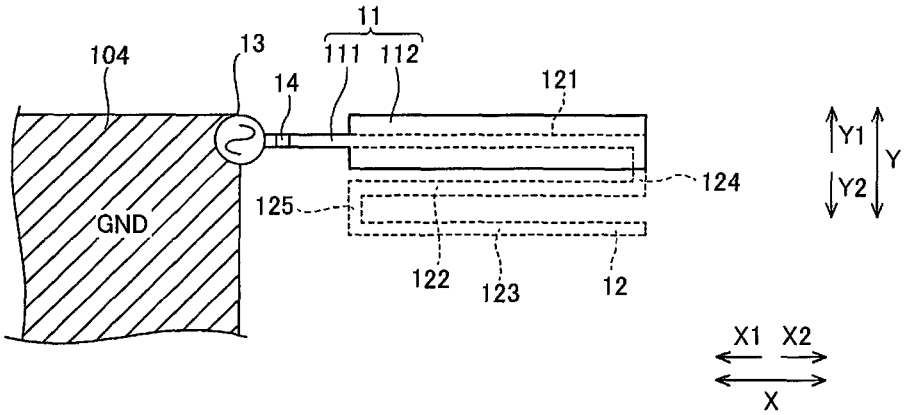
FIG. 12 is a diagram of the multi-antenna device in a first modification example of the first embodiment of the present invention.
Figure 13:
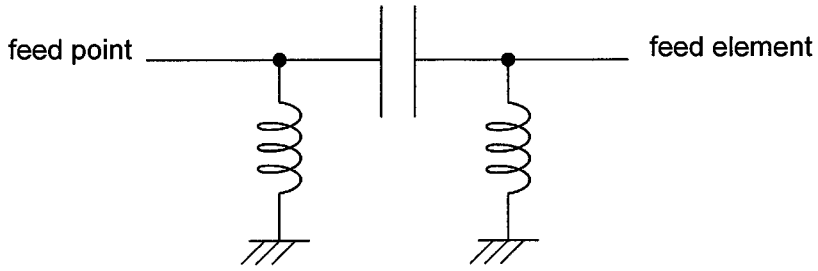
FIG. 13 is a diagram of a π-shaped rectification circuit for the multi-antenna device in the first modification example shown in FIG. 12.
Figure 14:
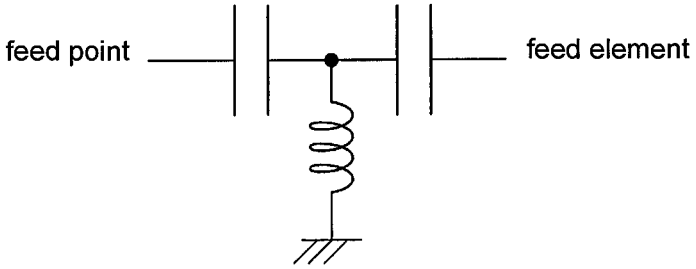
FIG. 14 is a diagram of a T-shaped rectification circuit for the multi-antenna device in the first modification example shown in FIG. 12.
Figure 15:
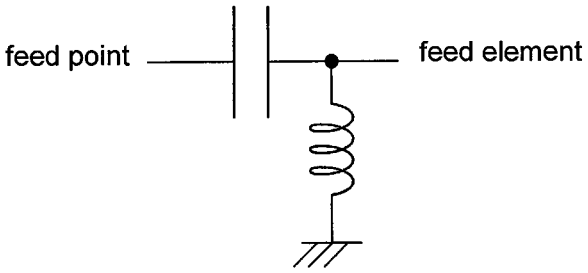
FIG. 15 is a diagram of an L-shaped rectification circuit for the multi-antenna device in the first modification example shown in FIG. 12.

Also, as shown in FIG. 12, there can be provided a matching circuit 14 for achieving impedance matching at a specific frequency. This reduces the transmission loss of energy transmitted through the feed element 11, since impedance matching is achieved, at a specific frequency. The matching circuit 14 can be constituted, for example, by a π-shaped circuit π matching) constituted by the inductor (coil) and capacitor shown in FIG. 13, by a T-shaped circuit constituted by the inductor and capacitor shown in FIG. 14, by the L-shaped circuit constituted by the inductor and capacitor shown in FIG. 15, or the like. The π-shaped circuit, T-shaped circuit, L-shaped circuit, etc., can be constituted by just an inductor or a capacitor, or by both an inductor and a capacitor.

Figure 16:
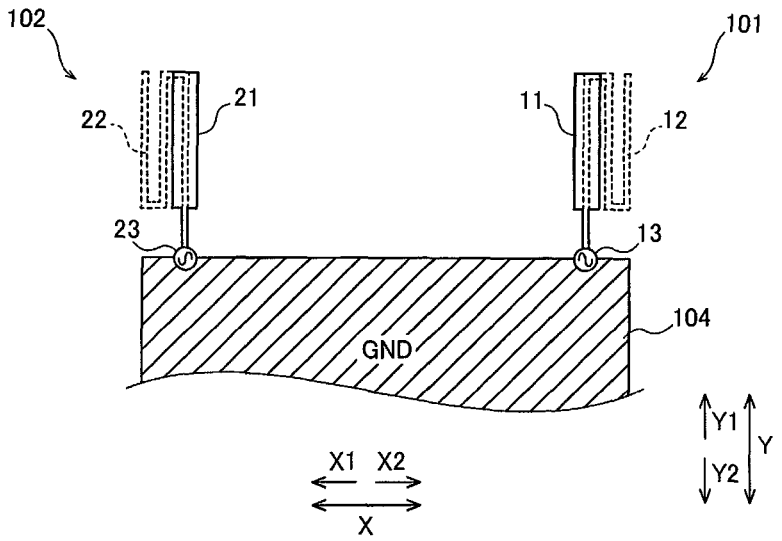
FIG. 16 is a diagram of the multi-antenna device in a second modification example of the first embodiment of the present invention.
Figure 17:
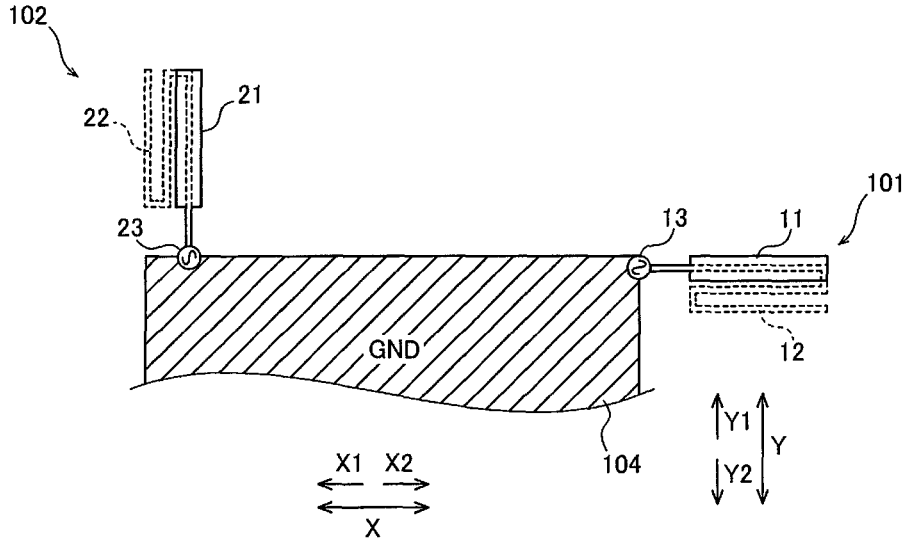
FIG. 17 is a diagram of the multi-antenna device in a third modification example of the first embodiment of the present invention.

Also, in the first embodiment above, an example was given in which the feed element of the first antenna and the feed element of the second antenna were both formed so as to extend in the X direction, but the present invention is not limited to or by this. As shown in FIG. 16, the feed element of the first antenna and the feed element of the second antenna can both be formed so as to extend in the Y direction. Also, as shown in FIG. 17, the feed element of the first antenna can be formed so as to extend in the X direction, while the feed element of the second antenna can be formed so as to extend in the Y direction. Specifically, the feed element of the first antenna and the feed element of the second antenna can be formed so as to extend in different directions.

Figure 18:
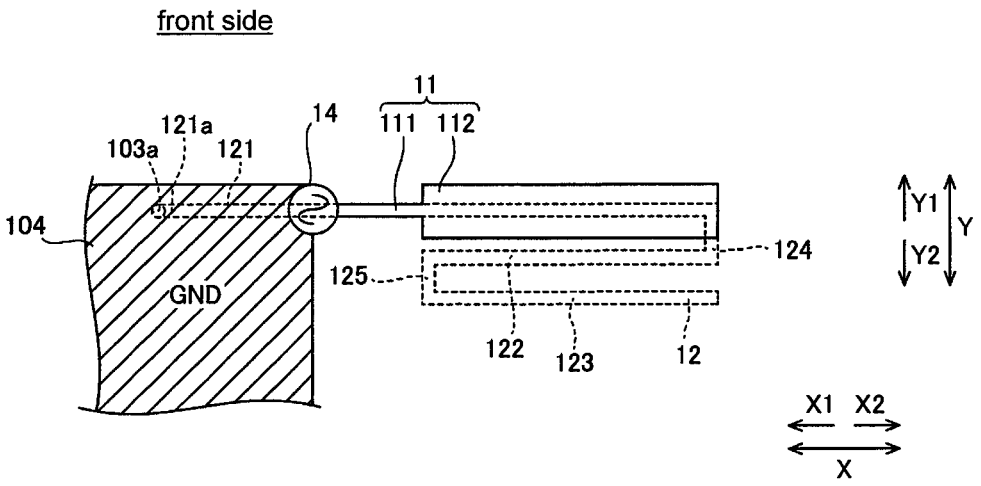
FIG. 18 is a diagram of the multi-antenna device in a fourth modification example of the first embodiment of the present invention.

Also, in the first embodiment above, an example was given in which the passive element 12 was grounded near the vertex of the second grounding plate 105, but the present invention is not limited to or by this. As shown in FIG. 18, the passive element 12 can be grounded to the first grounding plate 104. More specifically, the lower end 121*a* of the first linear part 121 of the passive element 12 disposed on the rear face of the board 103 (see FIG. 6) is disposed so as to overlap the first grounding plate 104 on the front face of the board 103 in plan view. An opening 103*a* (through-hole) that passes through in the thickness direction is formed in the board 103, and the lower end 121*a* of the first linear part 121 is grounded (connected) to the first grounding plate 104 disposed on the front face of the board 103 via the opening 103*a*. This obviates the need to provide a second grounding plate on the rear face of the board 103.

Figure 19:
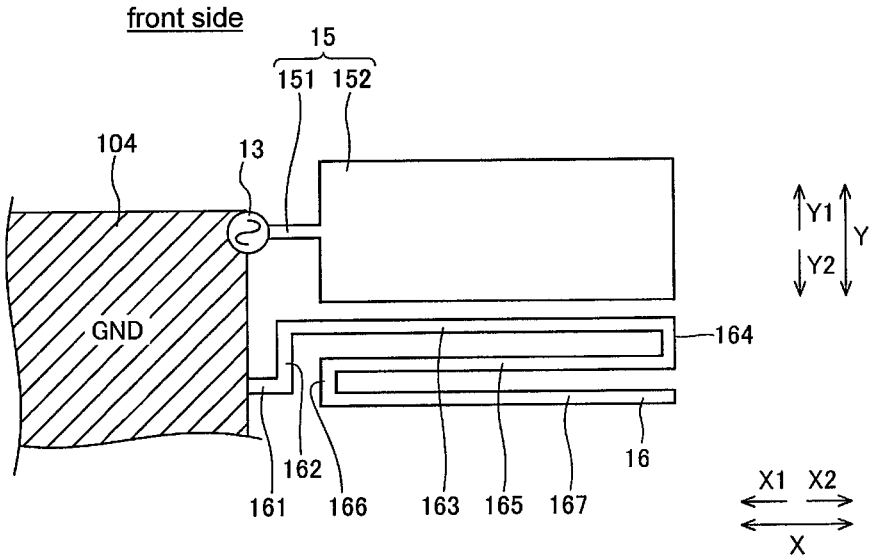
FIG. 19 is a diagram of the multi-antenna device in a fifth modification example of the first to fourth embodiments of the present invention.

Also, in the first to fourth embodiments above, an example was given in which the feed element and the passive element were provided to different layers, but the present invention is not limited to or by this. As shown in FIG. 19, the feed element and the passive element can be provided to the same layer.

More specifically, a feed element 15 and a passive element 16 are disposed in the same layer and spaced apart by a specific distance in the Y direction. The feed element 15 includes a first portion 151 that is grounded to the first grounding plate 104, and a second portion 152 that is wider than the first portion 151. The passive element 16 includes a first linear part 161 connected to the first grounding plate 104, a second linear part 162, a third linear part 163, a first linking part 164, a fourth linear part 165, a second linking part 166, and a fifth linear part 167. The first linear part 161, the third linear part 163, the fourth linear part 165, and the fifth linear part 167 are formed so as to extend in the X direction, and are disposed parallel to each other. The second linear part 162, the first linking part 164, and the second linking part 166 are formed so as to extend in the Y direction, and are disposed parallel to each other. The first linear part 161, the second linear part 162, the third linear part 163, the first linking part 164, the fourth linear part 165, the second linking part 166, and the fifth linear part 167 are examples of the "folded-back part" of the present invention.

Also, in the first to fourth embodiments above, an example was given in which the grounding plate was formed in a square shape, a circular shape, or a regular octagonal shape in point symmetry with the center, but the present invention is not limited to or by this. As long as the configuration is such that a straight line linking the first feed point and the center of the grounding plate, and a straight line linking the second feed point and the center of the grounding plate are substantially perpendicular to each other, the grounding plate can have a shape that is in point symmetry with the center other than a square shape, a circular shape, or a regular octagonal shape, and can be a grounding plate having a shape that is asymmetrical to the center.

As mentioned above, one object of the present disclosure is to provide a multi-antenna device with which broadband performance can be maintained while cross coupling between antennas is reduced. Another object of the present disclosure is to provide a communication device including such a multi-antenna device.

To solve the stated object, the inventors conducted painstaking research, and as a result discovered that broadband performance can be maintained while reducing cross coupling between antennas by disposing a straight line linking the first feed point of a first antenna with the center of a grounding plate and a straight line linking the second feed point of a second antenna and the center of the grounding plate such that they are substantially perpendicular to each other in plan view. The inventors confirmed by simulation (discussed above) that broadband performance can indeed be maintained while reducing cross coupling between antennas.

Specifically, the multi-antenna device pertaining to a first aspect includes a grounding plate, a first antenna including a first feed element that is grounded to the grounding plate via a first feed point, and a second antenna including a second feed element that is grounded to the grounding plate via a second feed point. The first feed point and the second feed point are disposed such that a straight line connecting the first feed point and a center of the grounding plate and a straight line connecting the second feed point and the center of the grounding plate are substantially perpendicular to each other in plan view.

With the multi-antenna device pertaining to the first aspect, as discussed above, the first feed point and the second feed point are disposed such that a straight line connecting the first feed point of the first antenna and the center of the grounding plate and a straight line connecting the second feed point of the second antenna and the center of the grounding plate are substantially perpendicular to each other in a plan view, which means that when the first antenna and second antenna are compatible with a wide frequency band, broadband performance can be maintained while reducing cross coupling between the antennas over the entire corresponding wide frequency band.

With the multi-antenna device pertaining to the first aspect, it is preferable if the grounding plate is formed in a shape that is substantially in point symmetry relative to the center of the grounding plate. With this configuration, broadband performance can be maintained while effectively reducing cross coupling between antennas.

With the multi-antenna device pertaining to the first aspect, it is preferable if the grounding plate has a polyhedral shape in the plan view, and the first feed point and the second feed point are each disposed near vertices of the grounding plate, respectively. With this configuration, the sides of the grounding plate constituting the vertices where the first feed point and the second feed point are disposed are made to function as an antenna, which effectively raises the emission efficiency.

In this case, it is preferable if the grounding plate has a substantially square shape in the plan view, and the first feed point and the second feed point are disposed near mutually adjacent vertices of the grounding plate, respectively. With this configuration, a grounding plate having a substantially square shape, which is easier to install, can be used to maintain broadband performance while effectively reducing cross coupling between antennas.

With the multi-antenna device pertaining to the first aspect, it is preferable if the first feed point and the second feed point are disposed near an outer edge of the grounding plate such that the outer edge of the grounding plate disposed between the first feed point and the second feed point has a length that corresponds to an electrical length of approximately one-half a wavelength of a frequency substantially in a middle of a frequency band at which a voltage standing wave ratio is at or below a specific value. With this configuration, the distance between the first feed point and second feed point will not be as large, and cross coupling between the antennas can be effectively reduced over the entire corresponding wide frequency band, so a more compact multi-antenna device can be achieved, while effectively reducing cross coupling between the antennas over the corresponding wide band.

With the multi-antenna device pertaining to the first aspect, it is preferable if the first antenna and the second antenna further include a first passive element and a second passive element, respectively, the first passive element and the second passive element each having a plurality of folded-back parts that are folded back at a plurality of locations, the first feed element and the second feed element each have a first portion and a second portion that is wider than the first portion, the second portions of the first feed element and the second feed element have widths that are greater than widths of the first passive element and the second passive element in a direction perpendicular to a direction in which the folded-back parts extend, respectively, and at least the second portions of the first feed element and the second feed element are configured to couple to the folded-back parts of the first passive element and the second passive element, respectively. "Coupling" here is a broad concept that encompasses both electrostatic coupling and magnetic field coupling. With this configuration, because the second portions of the feed elements and the folded-back parts of the passive elements are coupled, cross coupling can be reduced between antennas while still affording compatibility with ultra wide band (a band in which the ratio between the maximum and minimum usable frequencies is at least about 1.5 times). Also, because the plurality of folded-back parts ensure the length required for the first passive element and the second passive element, the installation area of the first passive element and second passive element does not have to be enlarged, and as a result, a more compact multi-antenna device can be obtained.

In this case, it is preferable if the first passive element and the second passive element are each grounded at one end to the grounding plate, and are each open at the other end. With this configuration, compatibility with ultra wide band frequencies can be easily achieved by coupling the second portions of the first feed element and second feed element with the first passive element and second passive element grounded to the grounding plate.

In a constitution in which the first antenna and second antenna each include a first passive element and a second passive element, it is preferable if the first feed element and the second feed element are disposed such that the first feed element and the second feed element overlap with the first passive element and the second passive element in the plan view, respectively. With this configuration, in each of the first antenna and second antenna, the feed element and the passive element are overlapped in plan view to reduce the planar installation area of the feed elements and the passive elements, which means that a more compact multi-antenna device can be easily obtained.

The communication device pertaining to a second aspect is a communication device having a multi-antenna device. The multi-antenna device at least includes a grounding plate, a first antenna including a first feed element that is grounded to the grounding plate via a first feed point, and a second antenna including a second feed element that is grounded to the grounding plate via a second feed point. The first feed point and the second feed point are disposed such that a straight line connecting the first feed point and a center of the grounding plate and a straight line connecting the second feed point and the center of the grounding plate are substantially perpendicular to each other in plan view.

With the communication device pertaining to the second aspect, as discussed above, since the first feed point and the second feed point are disposed such that a straight line connecting the first feed point of the first antenna and a center of the grounding plate and a straight line connecting the second feed point of the second antenna and the center of the grounding plate are substantially perpendicular to each other in a plan view, when the first antenna and second antenna are compatible with a wide frequency band, broadband performance can be maintained while reducing cross coupling between the antennas over the entire corresponding wide frequency band. In particular, with a communication device that will be used in a wide variety of situations, such as being used overseas or being used while moving, such as with a portable terminal, the present disclosure is more effective because broadband performance can be maintained while reducing cross coupling between the antennas.

As discussed above, with the present disclosure, broadband performance can be maintained while reducing cross coupling between the antennas.

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A multi-antenna device comprising:

a grounding plate;

a first antenna including a first feed element that is grounded to the grounding plate via a first feed point; and a second antenna including a second feed element that is grounded to the grounding plate via a second feed point, the first feed point and the second feed point being disposed relative to the grounding plate, with a straight line connecting the first feed point and a center of a whole of the grounding plate in a plan view and a straight line connecting the second feed point and the center of the whole of the grounding plate in the plan view being substantially perpendicular to each other.

2. The multi-antenna device according to claim 1, wherein the grounding plate is formed in a shape that is substantially in point symmetry relative to the center of the whole of the grounding plate.

3. The multi-antenna device according to claim 1, wherein the grounding plate has a polyhedral shape in the plan view, and the first feed point and the second feed point are disposed near vertices of the grounding plate, respectively.

4. The multi-antenna device according to claim 3, wherein the grounding plate has a substantially square shape in the plan view, and the first feed point and the second feed point are disposed near mutually adjacent vertices of the grounding plate, respectively.

5. The multi-antenna device according to claim 1, wherein the first feed point and the second feed point are disposed near an outer edge of the grounding plate, with the outer edge of the grounding plate disposed between the first feed point and the second feed point having a length that corresponds to an electrical length of approximately one-half a wavelength of a frequency substantially in a middle of a frequency band at which a voltage standing wave ratio is at or below a specific value.

6. The multi-antenna device according to claim 1, wherein the first feed point and the second feed point are disposed relative to the grounding plate, with the straight line connecting the first feed point and the center of the whole of the grounding plate and the straight line connecting the second feed point and the center of the whole of the grounding plate intersecting at an angle of between 84 degrees and 96 degrees.

7. The multi-antenna device according to claim 6, wherein the first feed point and the second feed point are disposed relative to the grounding plate, with the straight line connecting the first feed point and the center of the whole of the grounding plate and the straight line connecting the second feed point and the center of the whole of the grounding plate intersecting at an angle of 90 degrees.

8. A communication device comprising:

the multi-antenna device according to claim 1.

9. A multi-antenna device comprising:

a grounding plate;

a first antenna including a first feed element that is grounded to the grounding plate via a first feed point; and a second antenna including a second feed element that is grounded to the grounding plate via a second feed point., the first feed point and the second feed point being disposed relative to the grounding plate, with a straight line connecting the first feed point and a center of the grounding plate and a straight line connecting the second feed point and the center of the grounding plate being substantially perpendicular to each other in a plan view, the first antenna and the second antenna further including a first passive element and a second passive element, respectively, the first passive element and the second passive element each having a plurality of folded-back parts that are folded back at a plurality of locations, the first feed element and the second feed element each having a first portion and a second portion that is wider than the first portion, the second portions of the first feed element and the second feed element having widths that are greater than widths of the first passive element and the second passive element in a direction perpendicular to a direction in which the folded-back parts extend, respectively, and at least the second portions of the first feed element and the second feed element being coupled to the folded-back parts of the first passive element and the second passive element, respectively.

10. The multi-antenna device according to claim 9, wherein the first passive element and the second passive element are each grounded at one end to the grounding plate, and are each open at the other end.

11. The multi-antenna device according to claim 9, wherein the first feed element and the second feed element overlap with the first passive element and the second passive element in the plan view, respectively.

12. The multi-antenna device according to claim 9, wherein the first portions of the first feed element and the second feed element have widths that are equal to the widths of the first passive element and the second passive element, respectively.

13. The multi-antenna device according to claim 9, wherein the second portions of the first feed element and the second feed element have lengths that are equal to lengths of the folded-back parts of the first passive element and the second passive element in the direction in which the folded-back parts extend, respectively.

14. The multi-antenna device according to claim 9, wherein the first feed element and the second feed element have furthermost ends relative to the grounding plate that are aligned to furthermost ends of the first passive element and the second passive element in the plan view, respectively.

* * * * *